United States Patent [19]

Fear

[11] Patent Number: 4,630,733

[45] Date of Patent: Dec. 23, 1986

[54] PRODUCT INDICATING TAB

[75] Inventor: Robert E. Fear, Wheaton, Ill.

[73] Assignee: Continental Bondware, Inc., Rolling Meadows, Ill.

[21] Appl. No.: 811,366

[22] Filed: Dec. 20, 1985

[51] Int. Cl.[4] ..... B65D 73/00

[52] U.S. Cl. ..... 206/459; 206/605; 229/16 D; 229/17 R; 229/17 G

[58] Field of Search ..... 206/459, 601, 605; 229/16 R, 17 R, 17 G, 1.5 B, 16 D; 116/200, 335

[56] References Cited

U.S. PATENT DOCUMENTS

| | | | |
|---|---|---|---|
| 2,142,470 | 1/1939 | Claff | 206/459 |
| 2,731,188 | 1/1956 | Alden | 229/17 G |
| 2,954,916 | 10/1960 | Mela | 206/459 |
| 3,498,815 | 3/1970 | Bichaylo et al. | 206/459 |
| 3,762,625 | 10/1973 | Mojonnier | 229/17 G |
| 3,958,744 | 5/1976 | Herglotz | 229/16 R |
| 3,974,916 | 8/1976 | Bartolucci | 229/1.5 B |
| 4,244,474 | 1/1981 | Wise | 229/17 G |
| 4,345,393 | 8/1982 | Price et al. | 40/312 |

FOREIGN PATENT DOCUMENTS

| | | | |
|---|---|---|---|
| 678370 | 1/1964 | Canada | 229/17 G |

*Primary Examiner*—Joseph Man-Fu Moy
*Assistant Examiner*—David Fidei
*Attorney, Agent, or Firm*—Charles E. Brown

[57] ABSTRACT

This relates to a device for identifying a product which may be placed within a carton. Most particularly, it relates to cartons for drinks served at a fast food establishment. The carton is formed of a paperboard having a plastic facing both interiorly and exteriorly. Identifying indicia is printed on the carton adjacent a corner of the carton and tabs are defined by cut lines which extend through the outer plastic layer and terminate within the paperboard core with the paperboard being readily delaminatable. When the carton is folded to define corners, the tabs, which extend across the corners, automatically have their starting ends displaced from the plane of the paperboard so as to be readily grippable and removable. The projecting tabs also function as anti-stacking devices in that they project from the corners and prevent telescoped opened cartons from wedging one within the other when they are stacked for ease of handling and shipment.

11 Claims, 6 Drawing Figures

PRODUCT INDICATING TAB

This invention relates in general to new and useful improvements in cartons intended to have received therein various products, most particularly cartons for receiving different drinks in a fast food store, and most particularly to the formation of a tab or tabs for identifying the product.

Most particularly, the invention relates to a container or carton formed of a paperboard laminate generally known as polyboard. The laminate includes a paperboard core which is readily delaminatable and plastic surface layers or coatings.

In accordance with this invention, each tab is formed by a cut which extends through the plastic outer layer and terminates within the paperboard core. Most particularly, each tab has a rounded starting end which extends across a fold line in a blank from which the carton is formed so that when the carton is folded during the erection thereof, the starting end of the tab will automatically separate from the laminate and project from the corresponding corner of the carton. The rounded projecting tab may then be readily grasped for removal.

Associated with each tab is identifying indicia disposed adjacent the tail end of the tab, which tail end is preferably pointed. Further, the core is preferably of a different color from the outer surface layer so that when a tab is removed, there will be a color contrast pointing towards the associated indicia.

The projecting rounded starting end of the tab also serves a further function. Cartons of the type to which the invention is directed are generally stacked in their open state and have a tendency to wedge one within the other. The projecting starting end of the tab or tabs serves to prevent this wedging.

With the above and other objects in view that will hereinafter appear, the nature of the invention will be more clearly understood by reference to the following detailed description, the appended claims, and the several views illustrated in the accompanying drawing.

IN THE DRAWINGS

Figure 1:
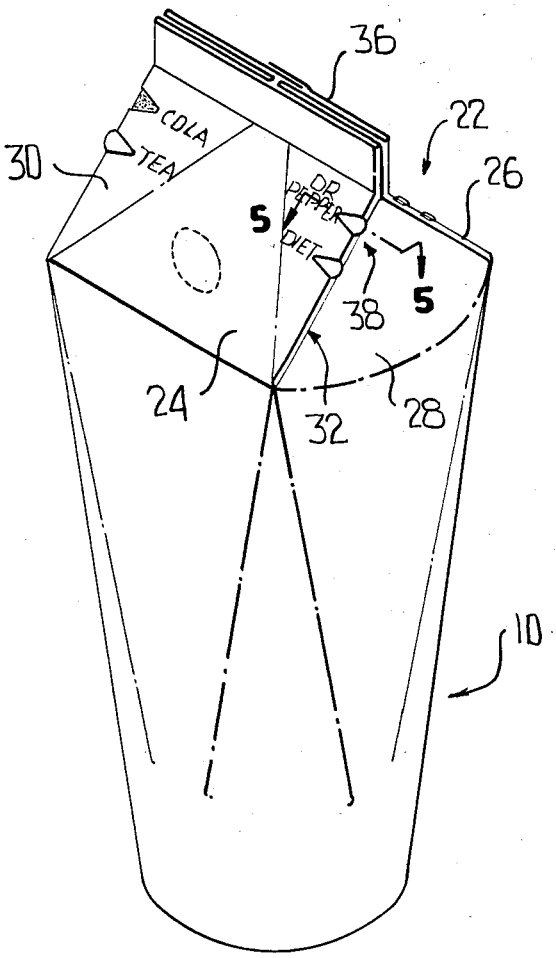
FIG. 1 is a top perspective view of a closed carton formed in accordance with this invention.

Referring now to the drawings in detail, it will be seen that there is illustrated in FIG. 1 a conventional carton generally identified by the numeral 10. The carton 10 is formed of a laminate best shown in FIG. 4 and identified by the reference numeral 12. The laminate includes a readily delaminatable paperboard core 14 with the opposite faces of the laminate 12 being formed of plastic material. The laminate 12 may be considered to have an outer surface layer or coating 16 and an inner surface layer or coating 18.

Normally the core 14 will be of a grayish white color as is common with paperboard while the outer surface layer 16 will preferably be colored in accordance with the color theme of the packager. Thus, as will be readily apparent hereinafter, when an associated tab is removed, there will be a color contrast to readily indicate the removal of such tab.

Figure 3:
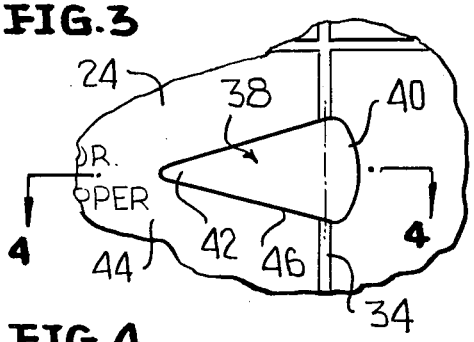
FIG. 3 is an enlarged plan view of a portion of the blank of FIG. 2 showing the specific details of one tab and its relationship to a fold line.

The carton 10 is formed from a blank, generally identified by the numeral 20, which is formed from the laminate 12, the blank 20 being shown in FIG. 3.

The carton 10 is provided with a folded closed top, generally identified by the numeral 22. The closed top 22 basically includes opposite top panels 24, 26 and folded top end panel arrangements 28, 30 so as to define at each end of each of the panels 24, 26 a corner 32. The corner 32 is defined in the blank 20 by a fold line 34. It is to be understood that there will be four such corners 32 defined by four fold lines 34.

The container 10 is closed by bonding together the opposed facing layers of a plurality of terminal flaps 36 as is best shown at the top of FIG. 1.

It is to be understood that the carton 10 is primarily intended to be utilized in the packaging of drinks and that the same carton 10 may be utilized in the packaging of numerous drinks. In the illustrated embodiment of the blank 20, eight such drinks are identified. A removed tab will identify the drink which has been packaged in the carton 10.

Referring now to FIG. 3, it will be seen that there is illustrated the construction of a typical tab, the tab being identified by the numeral 38. The tab 38 extends across the fold line 34 and has a rounded starting end 40 and tapers to a pointed trailing end 42. The associated panel, for example the panel 24, has printed thereon indicia 44 immediately adjacent the trailing end 42 of the tab.

Figure 4:
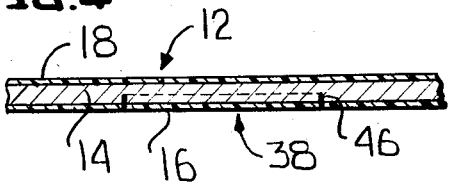
FIG. 4 is a fragmentary sectional view taken generally along the line 4—4 of FIG. 3 and shows the cut formed in the laminate from which the blank is formed so as to define the tab.

Each tab 38 is defined by a cut line 46. As is best shown in FIG. 4, the cut line 46 extends through the outer surface layer 16 and terminates within the core 14. Since the core 14 is formed of readily delaminatable paperboard, it will be seen that it is possible to tear the tab 38 out of the laminate 12.

Figure 5:
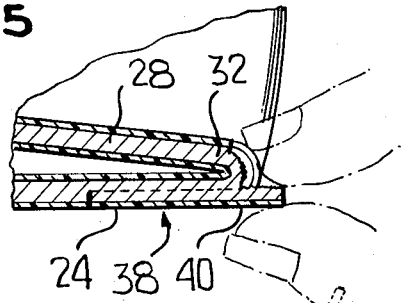
FIG. 5 is an enlarged fragmentary sectional view taken generally along the line 5—5 of FIG. 1 and shows the manner in which the rounded starting end of the tab is automatically separated from the laminate from which the carton is formed so that the rounded end will project.

In the folding of the blank 20 to form the carton 10, with the top of the carton open, there are formed the corners 32. In the forming of the corners 32, the starting end 40 of each tab 38 remains within the plane of the panel in which the tab 38 is primarily formed, as is best shown in FIG. 5, with the result that the tab starting end 40 projects from the corner. This projecting has a two fold advantage. First of all, the open cartons 10 are stacked for shipment and handling. The open cartons have a tendency to wedge together. However, the rounded starting portions 40 of the tabs project from their respective corners and prevent such wedging between the stacked containers. While this has not been specifically illustrated, it should be obvious to one skilled in the art how the tab will function to maintain a spacing between telescoped cartons.

Figure 6:
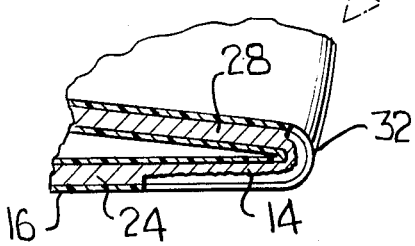
FIG. 6 is an enlarged fragmentary sectional view similar to FIG. 5 with the tab removed from the carton.

Next, and most particularly, because the rounded starting end 40 of the tab automatically delaminates from the remainder of the carton at the respective corner 32, the projecting starting end 40 may be readily grasped between one's thumb and forefinger, as shown in FIG. 5 for the removal of the tab. Thus after a particular drink has been packaged within the carton 10, the person filling the carton 10 may identify the product packaged therein by removing the proper tab 38. The carton with the tab removed is best shown in FIG. 6 wherein it will be seen that the core 14 will be readily observable and since the core 14 is of a different color from the outer surface layer 16, the removal of the tab 38 results in identifying indicia associated with the printed indicia so as to identify the packaged product.

It will be readily apparent that the identifying tabs 38 as well as the identifying indicia 44 associated therewith may be formed at practically no extra cost in that the indicia 44 may be part of the printing and the cut lines 46 may be part of the blank forming equipment. Therefore, except for the original setup cost, the tabs 38 may be formed at no extra cost.

Figure 2:
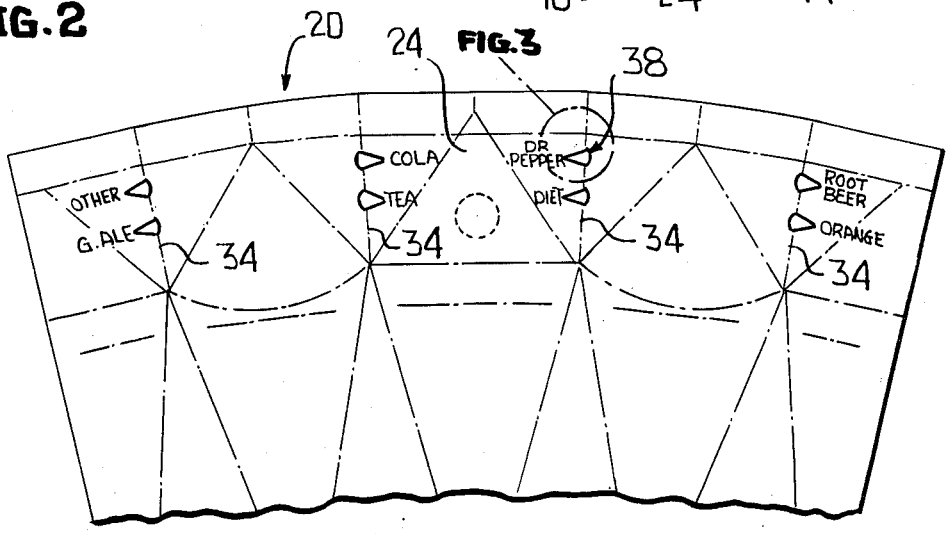
FIG. 2 is a fragmentary plan view of a blank from which the carton of FIG. 1 is folded.

It is again particularly pointed out that the carton 10 has plural corners 32 and that each corner 32 may have formed thereacross a plurality of the tabs 38. While the number of tabs 38 illustrated in FIG. 2 is eight, there may be more tabs along the various corners or there may be less.

Although only a preferred embodiment of the identification tab has been specifically illustrated and described herein, it is to be understood that minor variations may be made therein without departing from the spirit and scope of the invention as defined by the appended claims.

I claim:

1. A carton formed of a laminate including a core formed of a readily delaminatable material and separate inner and outer surface layers, said carton having at least one corner whereat said laminate is generally reversely folded, at least one product identifying tab formed at said corner by a cut line through said outer surface layer and terminating in said core, said product identifying tab having a starting end extending partially around said corner, and product identifying indicia on said carton adjacent said tab, said tab starting end being rounded to effect automatic separation of said tab starting end from said laminate when said laminate is folded to form said corner.

2. A carton according to claim 1 wherein said tab starting end is free of said laminate and projects beyond said carton at said corner for ease of grasping.

3. A carton according to claim 1 wherein said tab has a pointed tail end with the point of said tail end pointing towards said indicia.

4. A carton according to claim 1 wherein said core and said outer surface layer are differently colored to enhance the observation of a removed tab.

5. A carton according to claim 1 wherein said carton has a folded top portion, and said corner is part of said top portion.

6. A carton according to claim 5 wherein there are a plurality of said corners and there are said tabs on more than one of said corners.

7. A carton according to claim 5 wherein said folded top portion includes a top panel, said tab is primarily formed in said top panel, and said indicia is on said top panel.

8. A carton according to claim 1 wherein there are a plurality of tabs on said corner.

9. A carton according to claim 1 wherein said projecting tab starting end forms means for preventing wedging of cartons when said carbons are stacked in their open state.

10. A blank for a carton, said blank being formed of a laminate including a core formed of a readily delaminatable material and separate inner and outer surface layers, said blank having at least one fold line for defining a reversely folded corner between two panels separated by said fold line, a cut line through said outer surface layer and terminating in said core, said cut line defining a removable product identifying tab, said cut line extending across said fold line to have a starting portion in one of said panels and a tail portion in the other of said panels, and product identifying indicia on said other panel adjacent said tab tail portion, said tab starting end being rounded to effect automatic separation of said tab starting end from said laminate when said laminate is folded to form said corner.

11. A blank according to claim 10 wherein said core and said outer surface layer are differently colored to enhance the observation of a removed tab.

* * * * *